US007727699B2

(12) United States Patent
Kamiyoshi et al.

(10) Patent No.: US 7,727,699 B2
(45) Date of Patent: Jun. 1, 2010

(54) PROCESS FOR PRODUCING TONER FOR ELECTROPHOTOGRAPHY

(75) Inventors: Nobumichi Kamiyoshi, Wakayama (JP); Manabu Suzuki, Wakayama (JP); Yutaka Murai, Wakayama (JP)

(73) Assignee: Kao Corporation, Tokyo (JP)

( * ) Notice: Subject to any disclaimer, the term of this patent is extended or adjusted under 35 U.S.C. 154(b) by 285 days.

(21) Appl. No.: 11/851,795

(22) Filed: Sep. 7, 2007

(65) Prior Publication Data

US 2008/0233508 A1 Sep. 25, 2008

(30) Foreign Application Priority Data

Sep. 11, 2006 (JP) ..... 2006-245979
Dec. 27, 2006 (JP) ..... 2006-352706

(51) Int. Cl.
*G03G 9/10* (2006.01)

(52) U.S. Cl. ..... 430/137.14; 430/110.3; 430/110.4

(58) Field of Classification Search ..... 430/110.3, 430/137.14, 105, 110.4
See application file for complete search history.

(56) References Cited

U.S. PATENT DOCUMENTS

| | | | | |
|---|---|---|---|---|
| 5,403,693 | A * | 4/1995 | Patel et al. | 430/137.14 |
| 2003/0113647 | A1 * | 6/2003 | Matsushima et al. | 430/108.1 |
| 2006/0105262 | A1 | 5/2006 | Sata et al. | |

FOREIGN PATENT DOCUMENTS

| | | |
|---|---|---|
| JP | 7-146584 | 6/1995 |
| JP | 2002-131978 | 5/2002 |
| JP | 2003-66648 | 3/2003 |
| JP | 2004-295028 | 10/2004 |

* cited by examiner

*Primary Examiner*—John L Goodrow
(74) *Attorney, Agent, or Firm*—Oblon, Spivak, McClelland, Maier & Neustadt, L.L.P.

(57) ABSTRACT

The present invention relates to a process for producing a toner for electrophotography, including:

(a) a step of aggregating resin particles containing a resin binder in an aqueous medium; and (b) a step of unifying the aggregated resin particles, the step (a) including:

(a-1) a step of adding a monovalent salt as an aggregating agent; and (a-2) a step of adding at least one compound selected from the group consisting of alkylethersulfates represented by the formula (1):

$$R—O—(CH_2CH_2O)_nSO_3M \quad (1)$$

wherein R is an alkyl group; n represents an average molar number of addition and is a number of more than 0 and not more than 15 ($0<n\leqq 15$), and M is a monovalent cation, alkylsulfates and linear alkylbenzenesulfonates. The toner of the present invention has a small particle size which is controlled with a high accuracy, and a sharp particle size distribution, and a particle shape of the toner is readily controlled even at a low temperature, and further the obtained toner exhibits a high circularity.

10 Claims, No Drawings

PROCESS FOR PRODUCING TONER FOR ELECTROPHOTOGRAPHY

FIELD OF THE INVENTION

The present invention relates to a toner for electrophotography for use in electrophotographic method, electrostatic recording method, electrostatic printing method or the like, and a process for producing the toner.

BACKGROUND OF THE INVENTION

In the field of toners for electrophotography, with the progress of electrophotographic systems, it has been demanded to develop toners adaptable for high image quality and high copying speed. From the viewpoint of the high image quality, the toners are required to have a small particle size, and the particle size and particle shape thereof must be suitably controlled.

As the method of controlling a particle size of the toners with a high accuracy and attaining a sharp particle size distribution and a sharp charge distribution thereof, there is disclosed, for example, the process for producing a toner for developing an electrostatic latent image by subjecting resin particles contained in a dispersion to salting-out/aggregation to form toner particles which process includes a step of adding a salting-out agent, in particular, a di- or more valent salting-out agent to the dispersion (salting-out/aggregation step), and a step of adding a salting-out stopping agent to the dispersion at the time at which the toner particles is grown such that a volume-average particle size thereof reaches from 2 to 9 μm (particle growth-stopping step) (refer to JP 2003-66648A).

Also, as the technique for controlling a shape of toner particles at a low temperature, there is known the method of substantially decreasing a glass transition point of resin particles by adding thereto an organic solvent capable of being infinitely dissolved in water to effectively conduct melt-bonding/fusion of the particles (refer to JP 2004-295028A). Further, there is known the emulsion polymerization and aggregation method in which a surfactant such as an alkylbenzenesulfonic acid is added during growth of particles to thereby obtain toner particles having a narrow dimensional distribution (refer to JP 7-146584A). In addition, JP 2002-131978A discloses the process for producing styrene-acryl-based toner particles by conducting salting-out, aggregation and fusion thereof under the coexistence of a specific surfactant.

SUMMARY OF THE INVENTION

Thus, the present invention relates to:

(1) A process for producing a toner for electrophotography which includes:

(a) a step of aggregating resin particles containing a resin binder in an aqueous medium; and (b) a step of unifying the aggregated resin particles, the step (a) including:

(a-1) a step of adding a monovalent salt as an aggregating agent; and (a-2) a step of adding at least one compound selected from the group consisting of alkylethersulfates represented by the formula (1):

$$R—O—(CH_2CH_2O)_nSO_3M \quad (1)$$

wherein R is an alkyl group; n represents an average molar number of addition and is a number of more than 0 but not more than 15 ($0<n\leqq 15$), and M is a monovalent cation, alkylsulfates and linear alkylbenzenesulfonates; and (2) A toner for electrophotography which is produced by the process as defined in the above aspect (1).

DETAILED DESCRIPTION OF THE INVENTION

In the field of toners for electrophotography, there has been proposed a so-called chemical toner obtained by a chemical method such as a polymerization method and an emulsification and dispersion method in place of the conventional melt-kneading method. The chemical toner has been noticed from the standpoints of a small particle size and a sharp particle size distribution thereof. Also, the toner obtained by the conventional melt-kneading and pulverization method generally has an irregular particle shape. In this case, the toner tends to be insufficient in fluidity even though a fluidity-modifying assistant is added thereto, and tends to be deteriorated in fluidity with the passage of time by intrusion of fine particles present on a surface of the respective toner particles into recesses formed on each particle upon exposed to mechanical shearing force, or the fluidity-modifying assistant added tends to be buried within the toner, resulting in deterioration in developability, transfer property and cleanability. In addition, when such a toner is recovered by cleaning and reused in a developing device, the resultant toner image tends to be deteriorated in image quality. Thus, in any of the conventional techniques described in the above patent documents, the toners obtained therein have failed to exhibit a well-controlled particle size or particle shape.

The present invention relates to a process for producing a toner for electrophotography which is capable of not only controlling a particle size of the toner to a small level with a high accuracy but also obtaining the toner having a sharp particle size distribution; and a process for producing a toner for electrophotography which is capable of readily controlling a particle shape of the toner even at a low temperature and obtaining the toner having a high circularity; as well as toners for electrophotography which are produced by these processes.

[Process for Producing Toner for Electrophotography]

The process for producing a toner for electrophotography according to the present invention is described below.

The process for producing a toner for electrophotography according to the present invention includes (a) a step of aggregating resin particles containing a resin binder in an aqueous medium; and (b) a step of unifying the aggregated resin particles. The above step (a) further includes (a-1) a step of adding a monovalent salt as an aggregating agent; and (a-2) a step of adding at least one compound selected from the group consisting of alkylethersulfates represented by the above formula (1), alkylsulfates and linear alkylbenzenesulfonates.

In addition, in the above process for producing a toner for electrophotography, the step (a) further includes (i) a step of emulsifying the resin binder containing a polyester in an aqueous medium; and (ii) a step of aggregating emulsified particles contained in an emulsion obtained in the step (i) at a temperature not higher than the temperature calculated from the "glass transition point of the resin binder+(plus) 20° C."; the step (a-2) is a step of adding the at least one compound selected from the group consisting of alkylethersulfates represented by the above formula (1) and alkylsulfates, in an amount of 1.0 part by weight or more on the basis of 100 parts by weight of the resin binder; and the step (b) is a step of heating the aggregated particles at a temperature not lower than the temperature calculated from the "glass transition point of the resin binder+(plus) 10° C." and not higher than the temperature calculated from the "softening point of the resin binder−(minus) 10° C." for 2 h or longer to unify the aggregated particles.

(Step (a))

In the process for producing a toner for electrophotography according to the present invention, first, the resin particles containing the resin binder which is used in the step (a) (hereinafter occasionally referred to as "primary particles") are prepared in an aqueous medium.

Resin Binder

The resin binder preferably contains a polyester from the viewpoints of a good fixing property and a good durability of the toner. The content of the polyester in the resin binder is preferably 60% by weight or larger, more preferably 70% by weight or larger, even more preferably 80% by weight or larger and further even more preferably substantially 100% by weight from the viewpoints of a good fixing property and a good durability of the resultant toner. The polyester may be either a crystalline polyester or an amorphous polyester.

Examples of resins other than the polyester which may be contained in the resin binder include known resins conventionally used for toners such as styrene-acryl copolymers, epoxy resins, polycarbonates and polyurethanes.

The raw monomers of the polyester are not particularly limited, and there may be used a known alcohol component and a known carboxylic acid component such as a carboxylic acid, a carboxylic acid anhydride and a carboxylic acid ester.

As the alcohol component, there may be used di- or higher valent alcohols. Specific examples of the alcohol component include alkylene ($C_2$ to $C_3$) oxide adducts (average molar number of addition: 1 to 16) of bisphenol A such as polyoxypropylene-2,2-bis(4-hydroxyphenyl)propane and polyoxyethylene-2,2-bis(4-hydroxyphenyl)propane, ethylene glycol, propylene glycol, neopentyl glycol, 1,4-butanediol, 1,3-butanediol, 1,6-hexanediol, glycerol, pentaerythritol, trimethylol propane, hydrogenated bisphenol A, sorbitol, and alkylene ($C_2$ to $C_4$) oxide adducts (average molar number of addition: 1 to 16) of these compounds.

These alcohol components may be used alone or in combination of any two or more thereof.

As the carboxylic acid component, there may be used di- or higher valent carboxylic acids. Specific examples of the carboxylic acid component include dicarboxylic acids such as phthalic acid, isophthalic acid, terephthalic acid, sebacic acid, fumaric acid, maleic acid, adipic acid, azelaic acid, succinic acid and cyclohexanedicarboxylic acid; succinic acids substituted with an alkyl group having 1 to 20 carbon atoms or an alkenyl group having 2 to 20 carbon atoms such as dodecylsuccinic acid, dodecenylsuccinic acid and octenylsuccinic acid; tri- or higher valent polycarboxylic acids such as trimellitic acid, 2,5,7-naphthalene-tricarboxylic acid and pyromellitic acid; and anhydrides of these acids and alkyl ($C_1$ to $C_3$) esters thereof.

These carboxylic acid components may be used alone or in combination of any two or more thereof.

The polyester may be produced, for example, by polycondensing the alcohol component and the carboxylic acid component in an inert gas atmosphere at a temperature of about 180 to 250° C., if required, by using an esterification catalyst.

Examples of the esterification catalyst usable in the above reaction include tin compounds such as dibutyl tin oxide and tin dioctylate, and titanium compounds such as titanium diisopropylate bistriethanol aminate. The amount of the esterification catalyst used is preferably from 0.01 to 1 part by weight and more preferably from 0.1 to 0.6 part by weight on the basis of 100 parts by weight of a sum of the alcohol component and the carboxylic acid component.

Meanwhile, in the present invention, as the polyester, there may be used not only unmodified polyesters but also modified polyesters obtained by modifying polyesters to such an extent that the polyesters are substantially free from deterioration in inherent properties thereof. However, in the present invention, the unmodified polyesters are preferably used. Examples of the modified polyesters include polyesters grafted or blocked with phenol, urethane, epoxy, etc., by the methods described, for example, in JP 11-133668A, JP 10-239903A and JP 8-20636A, and composite resins containing two or more kinds of resin units including a polyester unit.

These polyesters may be used alone or in combination of any two or more thereof.

From the viewpoint of a good storage property of the resultant toner, the polyester preferably has a softening point of 70 to 165° C. and a glass transition point of 50 to 85° C. The acid value of the polyester is preferably from 6 to 35 mg KOH/g, more preferably from 10 to 35 mg KOH/g and even more preferably from 15 to 35 mg KOH/g from the viewpoint of facilitated production of the emulsion. The softening point or the acid value of the polyester may be desirably adjusted by controlling the temperature and time used in the polycondensation reaction.

From the viewpoint of a good durability of the resultant toner, the number-average molecular weight of the polyester is preferably from 1,000 to 50,000, more preferably from 1,000 to 10,000 and even more preferably from 2,000 to 8,000.

Meanwhile, when the resin binder is composed of a plurality of resins, the softening point, glass transition point, acid value and number-average molecular weight of the resin binder all mean those characteristic values of a mixture of these resins. The respective characteristic values of the mixture are preferably the same as the corresponding values of the polyesters.

Further, from the viewpoints of a good fixing property and a good durability of the toner, the resin binder used in the toner of the present invention may contain two kinds of polyesters which are different in softening point from each other in which one polyester (a) preferably has a softening point of not lower than 70 but lower than 115° C., and the other polyester (b) preferably has a softening point of from 115 to 165° C. The weight ratio of the polyester (a) to the polyester (b) (a/b) in the resin binder is preferably from 10/90 to 90/10 and more preferably from 50/50 to 90/10.

Aqueous Medium

The aqueous medium used for dispersing the resin particles contains water as a main component. From the viewpoint of a good environmental suitability, the water content in the aqueous medium is preferably 80% by weight or more, more preferably 90% by weight or more and most preferably 100% by weight.

Examples of components other than water which can be contained in the aqueous medium include water-soluble organic solvents such as methanol, ethanol, isopropanol, butanol, acetone, methyl ethyl ketone and tetrahydrofuran. Among these organic solvents, from the viewpoint of less inclusion into the toner, preferred are alcohol-based organic solvents incapable of dissolving resins therein such as methanol, ethanol, isopropanol and butanol. In the present invention, the resin binder is preferably dispersed in water solely without using substantially organic solvent to form fine particles thereof.

Production of Resin Emulsion Containing Resin Particles

In the present invention, first, the resin particles containing the resin binder are produced in the aqueous medium. The resin dispersion containing the resin particles is preferably produced by emulsifying the resin binder in the aqueous medium from the viewpoints of formation of the resin particles as primary particles having a small particle size and a sharp particle size distribution of the obtained toner.

The resin particles contained in the resin emulsion obtained by emulsifying the resin binder in the aqueous medium may contain, in addition to the resin binder, various optional additives such as a colorant, a releasing agent, a charge control agent, a reinforcing filler such as fibrous substances, an antioxidant and an anti-aging agent, if required.

The colorant is not particularly limited, and may be appropriately selected from known colorants according to the aims or requirements. Specific examples of the colorant include various pigments such as carbon blacks, inorganic composite oxides, Chrome Yellow, Hansa Yellow, Benzidine Yellow, Threne Yellow, Quinoline Yellow, Permanent Orange GTR, Pyrazolone Orange, Vulcan Orange, Watchung Red, Permanent Red, Brilliant Carmine 3B, Brilliant Carmine 6B, DuPont Oil Red, Pyrazolone Red, Lithol Red, Rhodamine B Lake, Lake Red C, red iron oxide, Methylene Blue Chloride, Phthalocyanine Blue, Phthalocyanine Green and Malachite Green Oxalate; and various dyes such as acridine dyes, xanthene dyes, azo dyes, benzoquinone dyes, azine dyes, anthraquinone dyes, indigo dyes, thioindigo dyes, phthalocyanine dyes, Aniline Black dyes and thiazole dyes. These colorants may be used alone or in combination of any two or more thereof.

The content of the colorant in the resin particles is preferably 20 parts by weight or less and more preferably from 0.01 to 10 parts by weight on the basis of 100 parts by weight of the resin binder.

Examples of the releasing agent include low-molecular weight polyolefins such as polyethylene, polypropylene and polybutene; silicones exhibiting a softening point upon heating; fatty amides such as oleamide, erucamide, ricinolamide and stearamide; vegetable waxes such as carnauba wax, rice wax, candelilla wax, haze wax and jojoba oil; animal waxes such as beeswax; mineral and petroleum waxes such as montan wax, ozokerite, ceresin, paraffin wax, microcrystalline wax and Fischer-Tropsch wax; and the like.

The content of the releasing agent in the resin particles is usually from about 1 to about 20 parts by weight, preferably from 1 to 20 parts by weight and preferably from 2 to 15 parts by weight on the basis of 100 parts by weight of the resin binder, or on the basis of 100 parts by weight of a sum of the resin binder and the colorant, if contained, in view of attaining good effects due to addition thereof and preventing adverse influence thereof from exerting on chargeability.

Examples of the charge control agent include metal salts of benzoic acid, metal salts of salicylic acid, metal salts of alkylsalicylic acids, metal salts of catechol, metal-containing bisazo dyes, tetraphenyl borate derivatives, quaternary ammonium salts and alkyl pyridinium salts.

The content of the charge control agent in the resin particles is preferably 10 parts by weight or less and more preferably from 0.01 to 5 parts by weight on the basis of 100 parts by weight of the resin binder.

In the present invention, upon emulsifying the resin binder in the aqueous medium, from the viewpoints of a good emulsification stability of the resin binder, etc., a surfactant is caused to be present therein in an amount of preferably 5 parts by weight or less, more preferably from 0.1 to 3.5 parts by weight and even more preferably from 0.1 to 3 parts by weight on the basis of 100 parts by weight of the resin binder.

Examples of the surfactant include anionic surfactants such as sulfate-based surfactants, sulfonate-based surfactants, phosphate-based surfactants and soap-based surfactants; cationic surfactants such as amine salt-type surfactants and quaternary ammonium salt-type surfactants; and nonionic surfactants such as polyethylene glycol-based surfactants, alkyl phenol ethyleneoxide adduct-based surfactants and polyhydric alcohol-based surfactants. Among these surfactants, preferred are ionic surfactants such as anionic surfactants and cationic surfactants. The nonionic surfactant is preferably used in combination with the anionic surfactant or the cationic surfactant. These surfactants may be used alone or in combination of any two or more thereof.

Specific examples of the anionic surfactants include dodecylbenzenesulfonic acid, sodium dodecylbenzenesulfonate, sodium dodecylsulfate, sodium alkylethersulfates, sodium alkylnaphthalenesulfonates and sodium dialkylsulfosuccinates. Specific examples of the cationic surfactants include alkylbenzenedimethyl ammonium chlorides, alkyltrimethyl ammonium chlorides and distearyl ammonium chloride.

Examples of the nonionic surfactant include polyoxyethylene alkyl aryl ethers or polyoxyethylene alkyl ethers such as polyoxyethylene nonylphenyl ether, polyoxyethylene oleyl ether and polyoxyethylene lauryl ether; polyoxyethylene sorbitan esters such as polyoxyethylene sorbitan monolaurate and polyoxyethylene sorbitan monostearate; polyoxyethylene fatty esters such as polyethylene glycol monolaurate, polyethylene glycol monostearate and polyethylene glycol monooleate; and oxyethylene/oxypropylene block copolymers.

Also, in the step (a), the resin binder is preferably dispersed together with optional additives in the aqueous medium by adding an aqueous alkali solution thereto.

The aqueous alkali solution used for dispersing the resin binder preferably has a concentration of from 1 to 20% by weight, more preferably from 1 to 10% by weight and even more preferably from 1.5 to 7.5% by weight. As the alkali of the aqueous alkali solution, there may be used such an alkali which allows a salt of the alkali and the polyester to exhibit an enhanced surface activity. Specific examples of the alkali include hydroxides of a monovalent alkali metal such as potassium hydroxide and sodium hydroxide.

After dispersing the resin binder in the aqueous medium, the resultant dispersion is neutralized at a temperature not lower than a glass transition point of the resin binder, and then an aqueous medium is added thereto at a temperature not lower than the glass transition point of the resin binder to cause a phase inversion and emulsify the resin binder, thereby preparing the resin dispersion.

The rate of addition of the aqueous medium is preferably from 0.5 to 50 g/min, more preferably from 0.5 to 40 g/min and even more preferably from 0.5 to 30 g/min per 100 g of the resin from the viewpoint of efficiently conducting the emulsifying step. The rate of addition of the aqueous medium may be generally maintained until an O/W type emulsion is substantially formed. Therefore, the rate of addition of the aqueous medium after forming the O/W type emulsion is not particularly limited.

Examples of the aqueous medium used upon production of the resin emulsion include the same aqueous media as described above. Among these aqueous media, preferred are deionized water and distilled water.

The amount of the aqueous medium used is preferably from 100 to 2000 parts by weight and more preferably from 150 to 1500 parts by weight on the basis of 100 parts by weight of the resin binder from the viewpoint of obtaining uniform aggregated particles in the subsequent aggregating treatment.

The amount of the aqueous medium used is controlled such that the solid content of the thus prepared resin emulsion is preferably from 7 to 50% by weight, more preferably from 7 to 40% by weight and even more preferably from 10 to 30% by weight, from the viewpoints of a good stability of the resultant resin emulsion and a good handling property of the resin emulsion. Meanwhile, the solid components contained in the resin emulsion may include nonvolatile components such as the resins and nonionic surfactant.

From the viewpoint of preparing a resin emulsion containing fine resin particles, the above emulsification is preferably conducted at a temperature not lower than the glass transition point of the resin binder and not higher than the softening point thereof. When the emulsification is conducted in the above-specified temperature range, the resin binder can be smoothly emulsified in the aqueous medium, and any special apparatus is not required therefor. From these viewpoints, the temperature used for the emulsification is preferably not lower than the temperature which is higher by 10° C. than the glass transition point of the resin binder (such a temperature is hereinafter referred to as the temperature calculated from the "glass transition point of the resin binder+(plus) 10° C.") and not higher than the temperature which is lower by 5° C. than the softening point of the resin binder (such a temperature is hereinafter referred to as the temperature calculated from the "softening point of the resin binder−(minus) 5° C.").

The volume-median particle size (D50) of the resin particles contained in the thus obtained resin dispersion is preferably from 0.02 to 2 μm, more preferably from 0.05 to 1 μm and even more preferably from 0.05 to 0.6 μm for the purpose of uniform aggregation thereof in the subsequent aggregating step. Meanwhile, the volume-median particle size (D50) used herein means a particle size at which a cumulative volume frequency calculated on the basis of a volume fraction of particles from a smaller particle size side thereof is 50%. The volume-median particle size may be measured by the below-mentioned method.

As an alternative method for obtaining the resin dispersion containing the resin particles, there may be used, for example, the method of emulsifying and dispersing a polycondensable monomer as a raw material of the aimed resin particles in an aqueous medium, for example, by applying a mechanical shearing force or an ultrasonic wave thereto. In this method, if required, additives such as a polycondensation catalyst and a surfactant may also be added to the aqueous medium. The polycondensation reaction of the monomer is allowed to proceed, for example, by heating the obtained mixture. For example, when using a polyester as the resin binder, there may be used the polycondensable monomers and the polycondensation catalysts for the above polyesters, and as the surfactant, there may also be used those as described above.

The polymerization of the polycondesable monomer for producing the polycondensed resin is usually accompanied with a dehydration reaction thereof and, therefore, does not principally proceed in the aqueous medium. However, for example, when the polycondesable monomer is emulsified in the aqueous medium in the presence of a surfactant capable of forming a micelle in the aqueous medium, the monomer is present in a micro hydrophobic site in the micelle and is subjected to dehydration reaction to produce water. By discharging the thus produced water into the aqueous medium outside of the micelle, the polymerization of the monomer can proceed. Thus, it is possible to produce the aimed dispersion by emulsifying and dispersing polycondensed resin particles in the aqueous medium even under an energy saving condition.

Aggregating Step

In the aggregating step (a), the resin particles contained in above prepared resin emulsion are aggregated in an aqueous medium. As the aqueous medium, there may be used the same aqueous medium as used for production of the resin particles.

The step (a) further includes (a-1) a step of adding a monovalent salt as an aggregating agent to the resin dispersion; and (a-2) a step of adding to the resin dispersion, at least one compound selected from the group consisting of alkylethersulfates, alkylsulfates represented by the above formula (1) and linear alkylbenzenesulfonates.

<Step (a-1)>

In the step (a-1), the aggregating agent is added to the resin dispersion to effectively conduct aggregation of the resin particles. In the present invention, from the viewpoints of controlling a particle size of the toner with a high accuracy and achieving a sharp particle size distribution thereof, a monovalent salt is used as the aggregating agent. The "monovalent salt" used herein means that a valence of a metal ion or an cation constituting the salt is 1. Examples of the monovalent salt as the aggregating agent include organic aggregating agents such as cationic surfactants in the form of a quaternary salt, and inorganic aggregating agents such as inorganic metal salts and ammonium salts. In the present invention, among these aggregating agents, from the viewpoints of controlling a particle size of the toner with a high accuracy and achieving a sharp particle size distribution thereof, preferred are water-soluble nitrogen-containing compounds having a molecular weight of 350 or less.

The water-soluble nitrogen-containing compounds having a molecular weight of 350 or less are preferably acidic compounds in order to rapidly aggregate the resin particles. The pH value of an aqueous solution containing 10% by weight of the water-soluble nitrogen-containing compound is preferably from 4 to 6 and more preferably from 4.2 to 6 as measured at 25° C. Also, from the viewpoints of a good charging property under high-temperature and high-humidity conditions, etc., the water-soluble nitrogen-containing compounds preferably have a molecular weight of 350 or less and more preferably 300 or less. Examples of the water-soluble nitrogen-containing compounds include ammonium salts such as ammonium halides, ammonium sulfate, ammonium acetate, ammonium benzoate and ammonium salicylate; and quaternary ammonium salts such as tetraalkyl ammonium halides. From the viewpoint of a good productivity, among these compounds, preferred are ammonium sulfate (pH value of 10 wt % aqueous solution at 25° C. (hereinafter referred to merely as a "pH"): 5.4), ammonium chloride (pH: 4.6), tetraethyl ammonium bromide (pH: 5.6) and tetrabutyl ammonium bromide (pH: 5.8).

The amount of the monovalent salt used is preferably 50 parts by weight or less, more preferably 40 parts by weight or less and even more preferably 30 parts by weight or less on the basis of 100 parts by weight of the resin binder, in particular, from the viewpoint of a good charging property under high-temperature and high-humidity conditions, and is preferably 1 part by weight or more, more preferably 2 parts by weight or more, even more preferably 3 parts by weight or more, further even more preferably 3.5 parts by weight or more and further even more preferably 5 parts by weight or more on the basis of 100 parts by weight of the resin binder from the viewpoint of a good aggregating property. From these viewpoints, the amount of the monovalent salt used is preferably from 1 to 50 parts by weight, more preferably from 3 to 40 parts by weight, even more preferably from 3.5 to 40 parts by weight and further even more preferably from 5 to 30 parts by weight on the basis of 100 parts by weight of the resin binder.

In order to attain a sharp particle size distribution and realize a uniform aggregation, the monovalent salt is added after suitably controlling the pH value of the reaction system at a temperature preferably not higher than the temperature calculated from the "glass transition point of the resin binder+(plus) 20° C.", more preferably not higher than the temperature calculated from the "glass transition point of the resin binder+(plus) 10° C.", even more preferably lower than the temperature calculated from the "glass transition point of the resin binder+(plus) 5° C.", further even more preferably not higher than the glass transition point of the resin binder, and further even more preferably not higher than the temperature calculated from the "glass transition point of the resin binder−(minus) 10° C.". Also, the monovalent salt may be added in the form of a solution thereof in an aqueous medium. In addition, the monovalent salt may be added to the resin dispersion at one time, or intermittently or continuously. Further, upon and after adding the monovalent salt, the obtained dispersion is preferably fully stirred.

<Step (a-2)>

In the step (a-2), at least one compound selected from the group consisting of alkylethersulfates represented by the following formula (1) is added to the resin dispersion.

$$R—O—(CH_2CH_2O)_nSO_3M \quad (1)$$

wherein R is an alkyl group; n represents an average molar number of addition and is a number of more than 0 and not more than 15 ($0<n\leqq 15$), and M is a monovalent cation, alkylsulfates and linear alkylbenzenesulfonates.

The alkyl group as R in the formula (1) is an alkyl group preferably having 4 to 20 carbon atoms, more preferably 6 to 20 carbon atoms, even more preferably 8 to 18 carbon atoms and further even more preferably 8 to 15 carbon atoms from the viewpoint of a good adsorption of the compound to the aggregated particles and a less residual amount of the compound in the toner. Specific examples of the alkyl group include butyl, pentyl, hexyl, heptyl, octyl, nonyl, decyl, dodecyl, tetradecyl, pentadecyl and octadecyl. The suffix n represents an average molar number of addition and is a number of more than 0 but not more than 15 ($0<n\leqq 15$). From the viewpoint of a well-controlled particle size, the lower limit of n is preferably 1, whereas the upper limit of n is preferably 10, more preferably 5 and even more preferably 3. Therefore, from the above viewpoint, n is preferably a number of from 1 to 15, more preferably a number of from 1 to 10, even more preferably a number of from 1 to 5 and further even more preferably a number of from 1 to 3. M is a monovalent cation. From the viewpoint of a well-controlled particle size, M is preferably a monovalent metal or ammonium, more preferably sodium, potassium or ammonium, and even more preferably sodium or ammonium. Specific examples of the preferred alkylethersulfates represented by the above formula (1) include sodium polyoxyethylene dodecylethersulfate and ammonium polyoxyethylene alkylethersulfates.

The alkylsulfates are not particularly limited. From the viewpoints of a good adsorption into the aggregated particles and a less residual amount in the toner, the alkylsulfates are preferably those compounds represented by the following formula (2):

$$R—O—SO_3M \quad (2)$$

wherein R and M are respectively the same as defined in the formula (1).

Examples of the preferred alkylsulfates include sodium octylsulfate, sodium decylsulfate, sodium dodecylsulfate and sodium tetradecylsulfate. Among these compounds, more preferred is sodium dodecylsulfate.

Also, the linear alkylbenzenesulfonates are not particularly limited. From the viewpoints of a good adsorption into the aggregated particles and a less residual amount in the toner, the linear alkylbenzenesulfonates are preferably those compounds represented by the following formula (3):

$$R\text{-}Ph\text{-}SO_3M \quad (3)$$

wherein R is a linear alkyl group; Ph is a phenyl group; and M is a monovalent cation. The linear alkyl group may be the same as those which are linear among the alkyl groups exemplified as R in the formula (1). Examples of the linear alkyl group include octyl, decyl, dodecyl, tetradecyl and octadecyl. As the suitable linear alkylbenzenesulfonates, there may be used sodium salts thereof.

The above alkylethersulfates, alkylsulfates and linear alkylbenzenesulfonates may be used alone or in combination of any two or more thereof.

In the step (a-2), the at least one compound selected from the group consisting of the above alkylethersulfates, alkylsulfates and linear alkylbenzenesulfonates is added in an amount of preferably from 0.5 to 15 parts by weight, more preferably from 1 to 10 parts by weight and even more preferably from 1 to 7 parts by weight on the basis of 100 parts by weight of the resin binder from the viewpoint of a good aggregation stopping property and a less residual amount in the toner.

From the viewpoint of a well-controlled particle shape in addition to the above viewpoints, the step (a-2) is preferably a step of adding at least one compound selected from the group consisting of the alkylethersulfates represented by the formula (1) and alkylsulfates. In this case, the at least one compound selected from the group consisting of the above alkyethersulfates and alkylsulfates is added in an amount of preferably 1.0 part by weight or more, more preferably 1.2 parts by weight or more, even more preferably 1.5 parts by weight or more, further even more preferably 2 parts by weight or more and further even more preferably 5 parts by weight or more on the basis of 100 parts by weight of the resin binder from the viewpoints of a good aggregation stopping property and well-controlled particle size and particle shape, and is preferably 30 parts by weight or less, more preferably 20 parts by weight or less and even more preferably 15 parts by weight or less on the basis of 100 parts by weight of the resin binder from the viewpoint of a less residual amount thereof in the toner. Therefore, from these viewpoints, the at least one compound selected from the group consisting of the above alkyethersulfates and alkylsulfates is preferably added in an amount of from 1.0 to 30 parts by weight, more preferably from 1.2 to 20 parts by weight, even more preferably from 1.5 to 20 parts by weight, further even more preferably from 2 to 20 parts by weight and further even more preferably from 5 to 15 parts by weight on the basis of 100 parts by weight of the resin binder.

The at least one compound selected from the group consisting of the above alkylethersulfates, alkylsulfates and linear alkylbenzenesulfonates may be added in any configuration as long as the amount of these compounds added lies within the above-specified range. From the viewpoint of a good productivity, the compound is preferably added in the form of an aqueous solution thereof. The compound may be added at one time, or intermittently or continuously. Further, upon and after adding the compound, the obtained dispersion is preferably fully stirred.

In the present invention, the above alkyethersulfates, alkylsulfates or linear alkylbenzenesulfonates are preferably used as an aggregation stopping agent for terminating aggregation of the resin particles. Therefore, these compounds as an aggregation stopping agent are preferably used after adding the above monovalent salt as an aggregating agent. More specifically, from the viewpoint of a well-controlled particle size, the aggregation stopping agent is added at the time at which the volume median particle size (D50) of the aggregated particles preferably reaches from 90 to 120% and more preferably from 100 to 120% of the volume median particle size (D50) of the resultant unified particles. The respective volume median particle sizes (D50) may be measured by the below-mentioned method.

<Addition of Fine Resin Particles>

In the present invention, from the viewpoints of preventing separation of the releasing agent or maintaining charge amounts of the respective colors in a color toner at the same level, etc., a step of adding an aqueous dispersion containing fine resin particles is preferably provided between the steps (a-1) and (a-2).

The aqueous dispersion containing fine resin particles which are usable in the above step is not particularly limited, and there may be used any aqueous dispersion containing resin particles which are ordinarily used for toners. In the present invention, from the viewpoint of a good low-temperature fixing property, the fine resin particles are preferably those obtained from the same resin as used in the above mentioned resin particles, and more preferably fine resin particles produced from the same raw materials as used for production of the above resin particles. The aqueous dispersion containing the fine resin particles may be prepared by the same method as used for producing the dispersion of the above resin particles containing the resin binder.

In the above step, the fine resin particles are mixed with the aggregated particles obtained by adding the aggregating agent in the step (a-1). In this case, from the viewpoints of preventing separation of the releasing agent or maintaining charge amounts of the respective toner particles at the same level, etc., the mixing ratio between the fine resin particles and the aggregated particles is controlled such that the fine resin particles are present in an amount of preferably from 5 to 100 parts by weight, more preferably from 15 to 85 parts by weight and even more preferably from 25 to 70 parts by weight on the basis of 100 parts by weight of the aggregated particles.

The fine resin particles are preferably added at the time between the steps (a-1) and (a-2). However, in the case where the monovalent salt as an aggregating agent is added continuously in the step (a-1), the fine resin particles may be added during a period of adding the monovalent salt. In the present invention, from the viewpoint of a good productivity, the fine resin particles are preferably added for a period between completion of addition of the monovalent salt in the step (a-1) and initiation of the step (a-2).

In the step (a), a surfactant other than the above alkyethersulfates, alkylsulfates or linear alkylbenzenesulfonates may be added, if required. As the surfactant, there may be used the same surfactants as used for producing the above primary particles containing the resin binder.

In order to ensure a uniform aggregation, the concentration of solids in the reaction system during the aggregating step is preferably from 5 to 50% by weight, more preferably from 5 to 40% by weight and even more preferably from 5 to 30% by weight.

Also, from the viewpoints of achieving both a good dispersion stability after the emulsification and a good aggregating property of fine particles of the resin binder, etc., the pH value of the reaction system is preferably from 2 to 10, more preferably from 3 to 9 and even more preferably from 4 to 8 as measured at 25° C.

From the same viewpoints as described above, the temperature of the reaction system in the aggregating step is preferably not higher than the glass transition point of the resin binder and more preferably not higher than the temperature calculated from the "glass transition point of the resin binder−(minus) 10° C.".

From the viewpoint of a high image quality, in the step (a), the volume median particle size (D50) of the aggregated particles is preferably from 1 to 10 μm, more preferably from 2 to 10 μm and even more preferably from 3 to 10 μm, and the coefficient of variation (CV value) of particle size distribution of the aggregated particles is preferably 30 or less, more preferably 25 or less and even more preferably 23 or less.

Meanwhile, the coefficient of variation (CV value) of particle size distribution means the value represented by the following formula. That is, the smaller the CV value, the more narrower the particle size distribution.

$$CV\ \text{Value}=(\text{Standard Deviation of Particle Size of Fine Particles}\ (\mu\text{m})/\text{Volume Median Particle Size}\ (\mu\text{m}))\times 100.$$

(Step (b))

The step (b) is a step for unifying the aggregated particles obtained in the step (a).

In the present invention, the aggregated particles obtained in the above aggregating step (a) are heated to form unified particles thereof. The heating temperature used upon the unifying step is preferably not lower than the glass transition point of the resin binder and not higher than the temperature calculated from the "softening point of the resin binder+(plus) 20° C."; more preferably not lower than the temperature calculated from the "grass transition point of the resin binder+(plus) 5° C." and not higher than the temperature calculated from the "softening point of the resin binder+(plus) 15° C."; and even more preferably not lower than the temperature calculated from the "grass transition point of the resin binder+(plus) 10° C." and not higher than the temperature calculated from the "softening point of the resin binder+(plus) 10° C." from the viewpoint of controlling a particle size, a particle size distribution and a shape of the toner as desired, and attaining a good fusibility of the aggregated particles. Form the above viewpoints, in particular, from the viewpoint of a well-controlled particle shape, the heating temperature used upon the unifying step is preferably not lower than the temperature calculated from the "grass transition point of the resin binder+(plus) 10° C." and not higher than the temperature calculated from the "softening point of the resin binder−(minus) 10° C."; and more preferably not lower than the temperature calculated from the "grass transition point of the resin binder+(plus) 10° C." and not higher than the temperature calculated from the "softening point of the resin binder−(minus) 20° C.". The aggregated particles are preferably heated at the above temperature for 2 h or more to obtain the unified particles. In addition, the stirring rate used in the unifying step is preferably a rate at which the aggregated particles are not precipitated.

In the present invention, the heating and the temperature rise accompanied therewith in the above unifying step is preferably conducted simultaneously with the addition of at least one compound selected from the group consisting of the above alkylethersulfates, alkylsulfates or linear alkylbenzenesulfonates, during the addition or within 1 h after the addition in the step (a), or at two or more times thereof. The heating and the temperature rise accompanied therewith in the above unifying step is more preferably conducted within 1 h and even more preferably within 30 min after the addition of at least one compound selected from the group consisting of the above alkylethersulfates, alkylsulfates or linear alkylbenzenesulfonates.

Further, the heating at the above temperature in the unifying step is preferably continued until the aggregated particles are fully unified and the circularity of the resultant unified particles reaches the aimed value. In the present invention, the heating is continued for 2 h or longer. The heating time is preferably 2.5 h or longer and more preferably 3 h or longer in order to completely unify the aggregated particles and thereby fully enhance a circularity of the unified particles. The upper limit of the heating time is not particularly limited, and is preferably 12 h or shorter and more preferably 8 h or shorter from the viewpoint of maintaining a good dispersibility of the respective components such as pigments in the aggregated particles. The heating time is calculated as a sum of all of the time periods in which the temperature is held within the above-specified temperature range.

The thus obtained unified particles may be subjected to a liquid-solid separation step such as filtration, a washing step, a drying step, etc., thereby obtaining toner particles. In the washing step, the unified particles are preferably washed with an acid to remove metal ions from the surface of the respective toner particles for the purpose of ensuring a sufficient chargeability and a good reliability of the resultant toner. Further, the nonionic surfactant added is also preferably completely removed from the unified particles by washing. Meanwhile, the washing procedure is preferably repeated a plurality of times.

In addition, in the drying step, any optional methods such as vibration-type fluidization drying method, spray-drying method, freeze-drying method and flash jet method may be employed. The water content in the toner particles obtained after drying is preferably adjusted to 1.5% by weight or less and more preferably 1.0% by weight or less from the viewpoint of a good chargeability of the resulting toner.

The volume median particle size (D50) of the unified particles is preferably from 1 to 10 μm, more preferably from 2 to 8 μm and even more preferably from 3 to 8 μm from the viewpoints of a high image quality.

[Toner for Electrophotography]

The toner for electrophotography according to the present invention is produced by the above production process including the steps (a) and (b), and has a small particle size suitable for achieving a high definition and a high image quality which is well controlled with a high accuracy, and exhibits a narrow particle size distribution and an excellent fixing property. More specifically, the toner of the present invention is produced by the process including the step (a) of aggregating resin particles containing a resin binder in an aqueous medium; and the step (b) of unifying the aggregated resin particles. In addition, the step (a) includes the step (a-1) of adding a monovalent salt as an aggregating agent; and the step (a-2) of adding at least one compound selected from the group consisting of alkylethersulfates represented by the above formula (1), alkylsulfates and linear alkylbenzenesulfonates. Further, the toner for electrophotography according to the present invention, is produced by the above production process in which the step (a) also includes the step (i) of emulsifying the resin binder containing a polyester in the aqueous medium and the step (ii) of aggregating emulsified particles contained in an emulsion obtained in the step (i) at a temperature not higher than the temperature calculated from the "glass transition point of the resin binder+(plus) 20° C.); the step (a-2) is a step of adding the at least one compound selected from the group consisting of alkylethersulfates represented by the formula (1) and alkylsulfates, in an amount of 1.0 part by weight or more on the basis of 100 parts by weight of the resin binder; and the step (b) includes a step of heating the aggregated particles at a temperature not lower than the temperature calculated from the "glass transition point of the resin binder+(plus) 10° C." and not higher than the temperature calculated from the "softening point of the resin binder−(minus) 10° C." for 2 h or longer to unify the particles. The toner produced by the above process is facilitated in control of its particle shape even at a low temperature, and exhibits a high circularity. The details of the steps (a) and (b), the steps (a-1) and (a-2) and the steps (i) and (ii) are respectively the same as those described above.

The obtained toner preferably has a softening point of from 60 to 140° C., more preferably from 60 to 130° C. and even more preferably from 60 to 120° C. from the viewpoint of a good low-temperature fixing property. In addition, the toner preferably has a glass transition point of from 30 to 80° C. and more preferably from 40 to 70° C. from the viewpoint of a good durability. Meanwhile, the softening point and the glass transition point of the toner may be measured according to the same methods as used above for measuring those of the resins.

In the toner for electrophotography according to the present invention, an external additive such as a fluidizing agent may be added to the surface of the toner particles. As the external additive, there may be used known fine particles. Examples of the fine particles include inorganic fine particles such as fine silica particles whose surface is subjected to a hydrophobic treatment, fine titanium oxide particles, fine alumina particles, fine cerium oxide particles and carbon blacks; and fine polymer particles such as fine particles made of polycarbonates, polymethyl methacrylate, silicone resins, etc. The external additive preferably has a number-average particle size of from 4 to 200 nm and more preferably from 8 to 30 nm. The number-average particle size of the external additive may be measured by using a scanning electron microscope or a transmission electron microscope.

The amount of the external additive formulated is preferably from 1 to 5 parts by weight and more preferably from 1.5 to 3.5 parts by weight on the basis of 100 parts by weight of the toner before being treated with the external additive.

The volume median particle size (D50) of the toner particles is preferably from 1 to 8 μm, more preferably from 1 to 7 μm, even more preferably from 1 to 6 μm, further even more preferably from 2 to 6 μm and further even more preferably from 3 to 6 μm from the viewpoint of a high image quality. Also, the average circularity of the toner is preferably from 0.94 to 1.0 and more preferably from 0.95 to 0.99.

In the present invention, the average circularity of the toner may be measured by using a flow type particle image analyzer, more specifically by using an analyzer "FPIA-3000" available from Sysmex Corp. The circularity of the particles used in the present invention means the value calculated from a ratio of a peripheral length of a circle having the same area as a projected area of a particle to a peripheral length of a projected image of the particle. As the shape of the particles is closer to a sphere, the circularity of the particles becomes closer to 1.

Also, the CV values of the above aggregated particles, unified particles and toner particles all are preferably 45 or less and more preferably 35 or less. In particular, the CV value of the toner is preferably 25 or less and more preferably 22 or less. Thus, the toner of the present invention preferably has the particle size and CV value as specified above. The particle size and the particle size distribution of the toner particles may be measured by the below-mentioned methods.

The toner for electrophotography obtained according to the present invention can be used as one-component system developer, or can be mixed with a carrier to form a two-component system developer.

[Method for Controlling Particle Size of Toner]

The present invention also relates to a method for controlling a particle size of a toner for electrophotography for use in a process for producing the toner which includes (a) a step of aggregating resin particles containing a resin binder in an aqueous medium; and (b) a step of unifying the aggregated resin particles, which method includes, in the step (a), (a-1) a step of adding a monovalent salt as an aggregating agent; and (a-2) a step of adding at least one compound selected from the group consisting of alkylethersulfates represented by the above formula (1), alkylsulfates and linear alkylbenzenesulfonates.

The details of the steps (a) and (b) and the steps (a-1) and (a-2) are respectively the same as those described above. In the present invention, by conducting the above method, the volume median particle size (D50) of the toner particles is controlled to preferably from 1 to 6 μm, more preferably from 2 to 6 μm and even more preferably 3 to 6 μm, so that the resultant toner exhibit a small particle size. Also, within the above-specified range, the toner can be controlled in particle size with a high accuracy, and the CV value of the toner particles can be controlled to preferably 25 or less and more preferably 22 or less.

[Method for Controlling Shape of Toner]

The present invention further relates to a method for controlling a shape of a toner which includes the steps of aggregating emulsified particles contained in an emulsion obtained by emulsifying a resin binder containing a polyester in an aqueous medium at a temperature not higher than the temperature calculated from the "glass transition point of the resin binder+(plus) 20° C."; adding at least one compound selected from the group consisting of alkylethersulfates represented by the above formula (1) and alkylsulfates, in an amount of 1.0 part by weight or more on the basis of 100 parts by weight of the resin binder to stop aggregation of the particles; and heating the aggregated particles at a temperature not lower than the temperature calculated from the "glass transition point of the resin binder+(plus) 10° C." and not higher than the temperature calculated from the "softening point of the resin binder−(minus) 10° C." for 2 h or longer to unify the aggregated particles.

The details of the respective steps in the above method are the same as those described above. Thus, in the present invention, by conducting the above method, the shape of toner particles can be optionally controlled, and the resultant toner particles can exhibit a high average circularity, more specifically, have an average circularity of preferably from 0.94 to 1.0 and more preferably from 0.95 to 0.99.

In accordance with the present invention, there are provided a process for producing a toner for electrophotography which is capable of not only controlling a particle size of the toner to a small value with a high accuracy but also enabling production of a toner having a sharp particle size distribution; a process for producing a toner for electrophotography which is capable of readily controlling a particle shape of the toner even at a low temperature and enabling production of a toner having a high circularity; and a toner for electrophotography produced by these processes.

As described above, the toner of the present invention can be suitably used in electrophotography, electrostatic recording method, electrostatic printing method or the like.

The present invention is described in more detail by referring to the following examples. However, it should be noted that these examples are only illustrative and not intended to limit the invention thereto.

In the following Production Examples, Examples and Comparative Examples, various properties were measured and evaluated by the following methods.

[Acid Value of Resins]

Determined according to JIS K0070. However, as the solvent for the measurement, there was used a mixed solvent containing acetone and toluene at a volume ratio of 1:1.

[Softening Point and Glass Transition Point of Resins and Toners]

(1) Softening Point

Using a flow tester "CFT-500D" available from Shimadzu Seisakusho Co., Ltd., 1 g of a sample was extruded through a nozzle having a die pore diameter of 1 mm and a length of 1 mm while heating the sample at a temperature rise rate of 6° C./min and applying a load of 1.96 MPa thereto by a plunger. The softening point was determined as the temperature at which a half the amount of the sample was flowed out when plotting a downward movement of the plunger of the flow tester relative to the temperature.

(2) Glass Transition Point

Using a differential scanning calorimeter ("DSC 210" commercially available from Seiko Instruments, Inc.), a sample was heated to 200° C. and then cooled from 200° C. to −10° C. at a temperature drop rate of 10° C./min, and thereafter heated again at temperature rise rate of 10° C./min to measure a glass transition point thereof. When a peak was observed at a temperature lower by 20° C. or more than the softening point, the peak temperature was read as the glass transition point. Whereas, when a shift of the characteristic curve was observed without any peaks at the temperature lower by 20° C. or more than the softening point, the temperature at which a tangential line having a maximum inclination of the curve in the portion of the curve shift was intersected with an extension of the baseline on the low-temperature side of the curve shift was read as the glass transition point.

[Number-Average Molecular Weight of Resins]

The number-average molecular weight was calculated from the molecular weight distribution measured by gel permeation chromatography according to the following method.

(1) Preparation of Sample Solution

The resin binder was dissolved in chloroform to prepare a solution having a concentration of 0.5 g/100 mL. The resultant solution was then filtered through a fluororesin filter ("FP-200" commercially available from Sumitomo Electric Industries, Ltd.) having a pore size of 2 μm to remove insoluble components therefrom, thereby obtaining a sample solution.

(2) Determination of Molecular Weight Distribution

Using the below-mentioned analyzer, chloroform was allowed to flow therethrough at a rate of 1 mL/min, and the column was stabilized in a thermostat at 40° C. One hundred microliters of the sample solution was injected to the column to determine a molecular weight distribution of the sample. The molecular weight of the sample was calculated on the basis of a calibration curve previously prepared. The calibration curve of the molecular weight was prepared by using several kinds of monodisperse polystyrenes (those polystyrenes having molecular weights of $2.63\times10^3$, $2.06\times10^4$ and $1.02\times10^5$ available from Tosoh Corporation; and those polystyrenes having molecular weights of $2.10\times10^3$, $7.00\times10^3$ and $5.04\times10^4$ available from GL Science Co., Ltd.) as standard samples.

Analyzer: CO-8010 (commercially available from Tosoh Corporation)

Column: GMHLX+G3000HXL (commercially available from Tosoh Corporation)

[Particle Size and Particle Size Distribution of Dispersed Resin Particles, Aggregated Particles, Unified Particles and Dispersed Releasing Agent Particles]

(1) Measuring Apparatus: Laser diffraction particle size analyzer ("LA-920" commercially available from Horiba Seisakusho Co., Ltd.)

(2) Measuring Conditions: Using a cell for the measurement which was filled with distilled water, a volume median particle size (D50) of the particles was measured at a temperature at which an absorbance thereof was within an adequate range. Meanwhile, the particle size distribution was indicated by the CV value calculated according to the following formula:

*CV* Value=(Standard Deviation of Particle Size Distribution/Volume Median Particle Size (D50))×100.

[Particle Size and Particle Size Distribution of Toner]

Measuring Apparatus Coulter Multisizer II (commercially available from Beckman Coulter Inc.)

Aperture Diameter: 50 μm

Analyzing Software: Coulter Multisizer AccuComp Ver. 1.19 (commercially available from Beckman Coulter Inc.)

Electrolyte Solution: "Isotone II" (commercially available from Beckman Coulter Inc.)

Dispersing Solution The dispersing solution was prepared by dissolving "EMULGEN 109P" (commercially available from Kao Corporation; polyoxyethylene lauryl ether; HLB: 13.6) in the above electrolyte solution such that the concentration of "EMULGEN 109P" in the obtained solution was 5% by weight.

Dispersing Conditions: Ten milligrams of a sample to be measured was added to 5 mL of the dispersing solution, and dispersed using an ultrasonic disperser for 1 min. Thereafter, 25 mL of the electrolyte solution was added to the dispersion, and the obtained mixture was further dispersed using the ultrasonic disperser for 1 min to prepare a sample dispersion.

Measuring Conditions: The thus prepared sample dispersion was added to 100 mL of the electrolyte solution, and after controlling a concentration of the resultant dispersion such that the determination for 30000 particles were completed at 20 s, the particle sizes of 30000 particles were measured under such a concentration condition, and a volume median particle size (D50) thereof was determined from the particle size distribution.

Meanwhile, the particle size distribution was indicated by the CV value calculated according to the following formula:

*CV* Value=(Standard Deviation of Particle Size Distribution/Volume Average Particle Size (D50))×100.

[Circularity of Toner]

Measuring Apparatus: Flow type Particle Image Analyzer "FPIA-3000" available from Sysmex Corp.

Measuring Conditions: One milliliters of the dispersion of the toner particles was sampled and diluted with distilled water to prepare a sample solution to be measured which had a concentration of 1/20 time that of the dispersion. Using a total count measurement (effective number of particles to be analyzed: 1000) as a counting method and setting a measuring mode to HPF and a magnification of an objective lens to 10 times, an average circularity of the particles contained in the sample solution was measured. The circularity of the particles is the value calculated from a ratio of a peripheral length of a circle having the same area as a projected area of the particle to a peripheral length of a projected image of the particle. As the shape of the particles is closer to a sphere, the circularity of the particles becomes closer to 1.

Production Example 1

Production of Polyester A

Under a nitrogen atmosphere, 8320 g of polyoxypropylene (2.2)-2,2-bis(4-hydroxyphenyl)propane, 80 g of polyoxyethylene (2.0)-2,2-bis(4-hydroxyphenyl)propane, 1592 g of terephthalic acid and 32 g of dibutyl tin oxide as an esterification catalyst were reacted with each other under normal pressure at 230° C. for 5 h, and further reacted under reduced pressure. After the obtained reaction product was cooled to 210° C., 1672 g of fumaric acid and 8 g of hydroquinone were added thereto to conduct a reaction therebetween for 5 h, and further the reaction was conducted under reduced pressure, thereby obtaining a polyester A. The polyester A had a softening point of 110° C., a glass transition point of 66° C., an acid value of 24.4 mg KOH/g, and a number-average molecular weight of 3760.

Production Example 2

Production of Polyester B

A four-necked flask equipped with a nitrogen inlet tube, a dehydration tube, a stirrer and a thermocouple was charged with 17500 g of polyoxypropylene (2.2)-2,2-bis(4-hydroxyphenyl)propane, 16250 g of polyoxyethylene (2.0)-2,2-bis(4-hydroxyphenyl)propane, 11454 g of terephthalic acid, 1608 g of dodecenyl succinic anhydride, 4800 g of trimellitic anhydride and 15 g of dibutyl tin oxide, and the contents of the flask were reacted with each other at 220° C. under a nitrogen atmosphere while stirring until the softening point as measured according to ASTM D36-86 reached 120° C., thereby obtaining a polyester B. The polyester B had a softening point of 121° C., a glass transition point of 65° C., an acid value of 18.5 mg KOH/g and a number-average molecular weight of 3394.

Production Example 3

Production of Master Batch 1

Seventy parts by weight of fine particles of the polyester A obtained in Production Example 1 and 30 parts by weight (in terms of a pigment content) of a slurry pigment of copper phthalocyanine ("ECB-301"; solid content: 46.2% by weight) available from Dai-Nichi Seika Co., Ltd., were charged into a Henschel mixer, and mixed with each other for 5 min to obtain a wet mixture. The resulting mixture was charged into a kneader-type mixer and gradually heated. The resin was melted at a temperature of about 90 to 110° C., and the mixture was kneaded under the condition that water was still present therein, and further continuously kneaded at a temperature of 90 to 110° C. for 20 min while evaporating water therefrom.

The resultant kneaded material was continuously kneaded at 120° C. to evaporate residual water therefrom, and dehydrated and dried, and further continuously kneaded at a temperature of 120 to 130° C. for 10 min. After cooling, the obtained kneaded material was further kneaded with a heating three-roll mill, cooled and coarsely crushed, thereby obtaining a high-concentration colored composition in the form of coarse particles containing 30% by weight of a blue pigment (master batch 1). The resultant composition was placed on a slide glass, and heat-melted. As a result of observing the melted composition by using a microscope, it was confirmed that the pigment particles were entirely finely dispersed in the composition, and no coarse particles were present therein.

Production Example 4

Production of Releasing Agent Dispersion A

After 3.57 g of an aqueous solution of dipotassium alkenyl succinate "LATEMUL ASK" (concentration of effective ingredients: 28%) available from Kao Corp., was dissolved in 400 g of deionized water in a 1 L beaker, 100 g of a carnauba wax (melting point: 85° C.) available from Kato Yokoh Co., Ltd., was dispersed in the resultant solution. While maintaining the obtained dispersion at a temperature of 90 to 95° C., the dispersion was subjected to dispersing treatment for 30 min by using "Ultrasonic Homogenizer 600W" available from Nippon Seiki Co., Ltd., thereby obtaining a releasing agent dispersion A having a volume median particle size (D50) of 0.39 μm, a CV value of 27 and a solid content of 25% by weight.

Production Example 5

Production of Resin Emulsion 1

A mixed resin composed of 800 g of the polyester A, 525 g of the polyester B and 250 g of the master batch 1 (the mixed resin obtained by mixing and melting the polyester A, the polyester B and the master batch 1 at such a mixing ratio had a softening point of 114° C. and a glass transition point of 64° C.), 100 g of an anionic surfactant "NEOPELEX G-15" (sodium dodecylbenzenesulfonate; solid content: 15% by weight) available from Kao Corporation, 15 g of a nonionic surfactant "EMULGEN 430" (polyoxyethylene (26 mol) oleyl ether; HLB: 16.2) available from Kao Corporation and 689 g of a 5 wt % potassium hydroxide aqueous solution were dispersed at 25° C. in a 5 L stainless steel pot while stirring with a paddle-shaped stirrer at a rate of 200 r/min. The contents of the pot were stabilized at 96° C., and held for 2 h while stirring with a paddle-shaped stirrer at a rate of 200 r/min. Successively, while stirring with a paddle-shaped stirrer at a rate of 200 r/min, 2845 g in total of deionized water was dropped into the pot at a rate of 15 g/min. The temperature of the reaction system was maintained at 96° C. After cooling, the obtained reaction mixture was passed through a wire mesh having a 150 mesh screen (opening: 105 μm) to obtain a resin emulsion 1 containing fine resin particles. The resin particles in the resultant resin emulsion 1 had a volume median particle size ($D_{50}$) of 0.14 μm and a solid content of 31% by weight. No residual resin components remained on the wire mesh.

Production Example 6

Production of Resin Emulsion 2

A mixed resin composed of 299 g of the polyester A, 210 g of the polyester B and 130 g of the master batch 1 (the mixed resin obtained by mixing and melting the polyester A, the polyester B and the master batch 1 at such a mixing ratio had a softening point of 114° C. and a glass transition point of 64° C.), 40 g of an anionic surfactant "NEOPELEX G-15" (sodium dodecylbenzenesulfonate; solid content: 15% by weight) available from Kao Corporation, 6 g of a nonionic surfactant "EMULGEN 430" (polyoxyethylene (26 mol) oleyl ether; HLB: 16.2) available from Kao Corporation and 275 g of a 5 wt % potassium hydroxide aqueous solution were dispersed at 25° C. in a 5 L stainless steel pot while stirring with a paddle-shaped stirrer at a rate of 200 r/min. The contents of the pot were stabilized at 96° C., and held for 2 h while stirring with a paddle-shaped stirrer at a rate of 200 r/min. Successively, while stirring with a paddle-shaped stirrer at a rate of 200 r/min, 1138 g in total of deionized water was dropped into the pot at a rate of 15 g/min. The temperature of the reaction system was maintained at 96° C. After cooling, the obtained reaction mixture was passed through a wire mesh having a 150 mesh screen (opening: 105 μm) to obtain a resin emulsion 2 containing fine resin particles. The resin particles in the resultant resin emulsion 2 had a volume median particle size (D50) of 0.17 μm and a solid content of 32% by weight. No residual resin components remained on the wire mesh.

Production Example 7

Production of Resin Emulsion 3

A mixed resin composed of 390 g of the polyester A and 210 g of the polyester B (the mixed resin obtained by mixing and melting the polyester A and the polyester B at such a mixing ratio had a softening point of 114° C. and a glass transition point of 64° C.), 40 g of an anionic surfactant "NEOPELEX G-15" (sodium dodecylbenzenesulfonate; solid content: 15% by weight) available from Kao Corporation, 6 g of a nonionic surfactant "EMULGEN 430" (polyoxyethylene (26 mol) oleyl ether; HLB: 16.2) available from Kao Corporation and 279 g of a 5 wt % potassium hydroxide aqueous solution were dispersed at 25° C. in a 5 L stainless steel pot while stirring with a paddle-shaped stirrer at a rate of 200 r/min. The contents of the pot were stabilized at 96° C., and held for 2 h while stirring with a paddle-shaped stirrer at a rate of 200 r/min. Successively, while stirring with a paddle-shaped stirrer at a rate of 200 r/min, 1135 g in total of deionized water was dropped into the pot at a rate of 6 g/min. The temperature of the reaction system was maintained at 96° C. After cooling, the obtained reaction mixture was passed through a wire mesh having a 150 mesh screen (opening: 105 μm) to obtain a resin emulsion 3 containing fine resin particles. The resin particles in the resultant resin emulsion 3 had a volume median particle size (D50) of 0.14 g/m and a solid content of 31% by weight. No residual resin components remained on the wire mesh.

Example 1

Production of Cyan Toner 1

Six hundred grams of the resin emulsion 1 was charged into a 2 L glass container, and mixed at room temperature. Then, while stirring the dispersion with a paddle-shaped stirrer at a rate of 100 r/min, a 5.5 wt % aqueous solution prepared by dissolving 40 g of ammonium sulfate (guaranteed reagent available from Sigma Aldrich Japan Co., Ltd.) as an aggregating agent in 694 g of deionized water was dropped into the mixture at room temperature over 10 min. Thereafter, the resultant mixed dispersion was heated to 60° C. at a rate of 0.19° C./min to form aggregated particles. The obtained dispersion was held at 60° C. for 3 h. Then, an aqueous solution prepared by diluting 42 g of a sodium polyoxyethylene (2 mol) dodecylethersulfate aqueous solution (solid content: 28% by weight) with 376 g of deionized water, as an aggregation stopping agent, was added to the resultant dispersion. At this time, the obtained aggregated particles had a volume median particle size (D50) of 7.6 μm and a CV value of 25. Twenty minutes after the addition, the dispersion was heated to 83° C. at a rate of 0.77° C./min and stirred at 83° C. for 1 h, and then the heating was stopped. During the above procedure, it was confirmed that the configuration of the toner was changed from the aggregated particles to unified particles. The thus obtained unified particles had a volume median particle size (D50) of 7.3 μm and a CV value of 27.

The resultant dispersion was gradually cooled to room temperature, and then subjected to a suction filtration step, a washing step and a drying step to obtain colored resin particles.

Next, a hydrophobic silica ("TS530" commercially available from Wacker Chemical Corp.; number-average primary particle size: 8 nm) was externally added to the colored resin particles in an amount of 1.0 part by weight on the basis of 100 parts by weight of the colored resin particles by using a Henschel mixer to obtain a cyan toner 1. The thus obtained cyan toner 1 had a volume median particle size (D50) of 5.0 μm and a CV value of 20. The resultant cyan toner 1 was loaded to a commercially available full-color printer to form printed images. As a result, it was confirmed that the obtained printed images were good. Meanwhile, the cyan toner 1 had a glass transition point of 55° C.

Example 2

Production of Cyan Toner 2

The same procedure as in Example 1 was repeated except for using sodium dodecylsulfate in place of the aggregation stopping agent used in Example 1, thereby obtaining a cyan toner 2.

The resultant cyan toner 2 was loaded to a commercially available full-color printer to form printed images. As a result, it was confirmed that the obtained printed images were good. Meanwhile, the cyan toner 2 had a glass transition point of 58° C.

Example 3

Production of Cyan Toner 3

The same procedure as in Example 1 was repeated except for using sodium dodecylbenzenesulfonate in place of the aggregation stopping agent used in Example 1, thereby obtaining a cyan toner 3.

The resultant cyan toner 3 was loaded to a commercially available full-color printer to form printed images. As a result, it was confirmed that the obtained printed images were good. Meanwhile, the cyan toner 3 had a glass transition point of 58° C.

Example 4

Production of Cyan Toner 4

The same procedure as in Example 1 was repeated except for using sodium polyoxyethylene (3 mol) dodecylethersulfate in place of the aggregation stopping agent used in Example 1, thereby obtaining a cyan toner 4.

The resultant cyan toner 4 was loaded to a commercially available full-color printer to form printed images. As a result, it was confirmed that the obtained printed images were good. Meanwhile, the cyan toner 4 had a glass transition point of 55° C.

Example 5

Production of Cyan Toner 5

Five hundred grams of the resin emulsion 2 and 34 g of the releasing agent dispersion A were charged into a 2 L glass container, and mixed with each other at room temperature. Then, while stirring the resultant mixture with a paddle-shaped stirrer at a rate of 100 r/min, a 29 wt % aqueous solution prepared by dissolving 18 g of ammonium sulfate (guaranteed reagent available from Sigma Aldrich Japan Co., Ltd.) as an aggregating agent in 43 g of deionized water was dropped into the mixture at room temperature over 10 min. Thereafter, the resultant mixed dispersion was heated to 55° C. at a rate of 0.17° C./min to form aggregated particles. The obtained dispersion was held at 55° C. for 3 h. Then, a dilute dispersion prepared by diluting 147 g of the resin emulsion 3 with 32 g of deionized water was dropped into the above dispersion at a rate of 2 mL/min. After completion of the dropping, an aqueous solution prepared by diluting 16 g of a sodium polyoxyethylene (2 mol) dodecylethersulfate aqueous solution (solid content: 28% by weight) with 141 g of deionized water, as an aggregation stopping agent, was added to the resultant dispersion. At this time, the obtained aggregated particles had a volume median particle size (D50) of 4.3 μm and a CV value of 42. Twenty minutes after the addition, the dispersion was heated to 80° C. at a rate of 0.14° C./min and stirred at 80° C. for 2 h, and then the heating was stopped. During the above procedure, it was confirmed that the configuration of the toner was changed from the aggregated particles to unified particles. The thus obtained unified particles had a volume median particle size (D50) of 3.9 μm and a CV value of 35.

The resultant dispersion was gradually cooled to room temperature, and then subjected to a suction filtration step, a washing step and a drying step to obtain colored resin particles.

Next, a hydrophobic silica ("TS530" commercially available from Wacker Chemical Corp.; number-average primary particle size: 8 nm) was externally added to the colored resin particles in an amount of 1.0 part by weight on the basis of 100 parts by weight of the colored resin particles by using a Henschel mixer to obtain a cyan toner 5. The thus obtained cyan toner 5 had a volume median particle size (D50) of 3.0 μm and a CV value of 19. The resultant cyan toner 5 was loaded to a commercially available full-color printer to form printed images. As a result, it was confirmed that the obtained printed images were good. Meanwhile, the cyan toner 5 had a glass transition point of 53° C.

Comparative Example 1

Production of Cyan Toner 6

The same procedure as in Example 1 was repeated except for using polyoxyethylene (9 mol) dodecylether in place of the aggregation stopping agent used in Example 1. However, when reaching 83° C., the particles were aggregated to much larger size than it should be. Therefore, the procedure for production of the toner was interrupted.

Comparative Example 2

Production of Cyan Toner 7

The same procedure as in Example 1 was repeated except for using sodium ditridecylsulfosuccinate in place of the aggregation stopping agent used in Example 1. However, when reaching 83° C., the particles were aggregated to much larger size than it should be. Therefore, the procedure for production of the toner was interrupted.

Comparative Example 3

Production of Cyan Toner 8

The same procedure as in Example 1 was repeated except for using dipotassium alkenyl (hexadecenyl/octadecenyl) succinate in place of the aggregation stopping agent used in Example 1, thereby obtaining a cyan toner 8. However, the resultant cyan toner 8 caused filming and failed to form a developed image when loaded to a commercially available full-color printer. Meanwhile, the cyan toner 8 had a glass transition point of 49° C.

Comparative Example 4

Production of Cyan Toner 9

The same procedure as in Example 1 was repeated except for using polyoxyethylene (18 mol) decylethersulfate in place of the aggregation stopping agent used in Example 1. However, when reaching 83° C., the aggregated particles were re-dispersed. Therefore, the procedure for production of the toner was interrupted.

The particle sizes and CV values of the aggregated particles, unified particles and toners respectively obtained in Examples 1 to 5 and Comparative Examples 1 to 4 are shown in Table 1 below. In addition, the particle size-controlling property was examined by an aggregation stopping performance (in terms of a rate of change in particle size represented by the following formula) and evaluated according to the following evaluation criteria.

Rate of Change in Particle Size=[100−(Particle Size of Aggregated Particles/Particle Size of Unified Particles)×100](%)

Evaluation Criteria for Aggregation Stopping Performance

4: The rate of change in particle size was within ±5%

3: The rate of change in particle size was within ±10%

2: The rate of change in particle size was within ±20%

1: The rate of change in particle size exceeded ±20%

TABLE 1-1

| | Examples | | | | |
|---|---|---|---|---|---|
| | 1 | 2 | 3 | 4 | 5 |
| Components added (g) | | | | | |
| Resin emulsion 1 | 600 | 600 | 600 | 600 | — |
| Resin emulsion 2 | — | — | — | — | 500 |
| Resin emulsion 3 | — | — | — | — | 147 |
| Releasing agent dispersion A | — | — | — | — | 34 |
| Aggregating agent (ammonium sulfate) | 40 | 40 | 40 | 40 | 18 |
| Aggregation stopping agent | SA*1 | SA*2 | SA*3 | SA*4 | SA*1 |
| | 12 | 12 | 12 | 12 | 7 |
| Particle size (D50) (μm) | | | | | |
| Aggregated particles | 7.6 | 8.2 | 8.0 | 6.7 | 4.2 |
| Unified particles | 7.3 | 8.6 | 7.8 | 6.3 | 3.9 |
| Toner | 5.0 | 5.7 | 5.6 | 4.0 | 3.0 |
| Ratio of aggregated particles to unified particles | 1.04 | 1.03 | 1.03 | 1.06 | 1.08 |
| Rate of change in particle size (%) | −4 | −3 | −3 | −6 | −8 |
| CV value | | | | | |
| Aggregated particles | 25 | 25 | 25 | 30 | 42 |
| Unified particles | 27 | 26 | 25 | 33 | 35 |
| Toner | 20 | 20 | 21 | 20 | 19 |
| Aggregation stopping performance | 4 | 4 | 4 | 3 | 3 |
| Developability | Good | Good | Good | Good | Good |

Note
*1Sodium polyoxyethylene (2 mol) dodecylethersulfate
*2Sodium dodecylsulfate
*3Sodium dodecylbenzenesulfonate
*4Sodium polyoxyethylene (3 mol) dodecylethersulfate

TABLE 1-2

| | Comparative Examples | | | |
|---|---|---|---|---|
| | 1 | 2 | 3 | 4 |
| Components added (g) | | | | |
| Resin emulsion 1 | 600 | 600 | 600 | 600 |
| Resin emulsion 2 | — | — | — | — |
| Resin emulsion 3 | — | — | — | — |
| Releasing agent dispersion A | — | — | — | — |
| Aggregating agent (ammonium sulfate) | 40 | 40 | 40 | 40 |
| Aggregation stopping agent | SA*5 | SA*6 | SA*7 | SA*8 |
| | 12 | 12 | 12 | 12 |
| Particle size (D50) (μm) | | | | |
| Aggregated particles | 8.0 | 8.1 | 8.0 | 6.4 |
| Unified particles | 9.0 | 9.8 | 8.7 | 4.6 |
| Toner | — | — | 6.1 | — |
| Ratio of aggregated particles to unified particles | 0.09 | 0.83 | 0.92 | 1.39 |
| Rate of change in particle size (%) | 91 | 17 | 8 | −39 |
| CV value | | | | |
| Aggregated particles | 25 | 25 | 25 | 30 |
| Unified particles | 36 | 52 | 23 | 60 |
| Toner | — | — | 18 | — |
| Aggregation stopping performance | 1 | 2 | 3 | 1 |

TABLE 1-2-continued

| | Comparative Examples | | | |
|---|---|---|---|---|
| | 1 | 2 | 3 | 4 |
| Developability | — | — | Not developable | — |

Note
*5Polyoxyethylene (9 mol) dodecylether
*6Sodium ditridecylsulfosuccinate
*7Dipotassium hexadecenyl/octadecenyl succinate
*8Sodium polyoxyethylene (18 mol) dodecylethersulfate Production Example 8

Production of Resin Emulsion 4

A mixed resin composed of 1866 g of the polyester A, 1225 g of the polyester B and 584.5 g of the master batch 1, 35.0 g of a nonionic surfactant "EMULGEN 430" available from Kao Corp., 233.3 g of an anionic surfactant "NEOPELEX G-15" (a 15 wt % aqueous solution of sodium dodecylbenzenesulfonate) available from Kao Corp., and 1608 g of a 5 wt % potassium hydroxide aqueous solution as a neutralizing agent, were charged into a 5 L stainless steel pot, and melted for 2 h at 98° C. while stirring with a paddle-shaped stirrer at a rate of 200 rpm, thereby obtaining a resin binder mixture. Next, deionized water was dropped in a total amount of 6639 g to the mixture at a rate of 35 g/min while stirring with the paddle-shaped stirrer at a rate of 200 rpm, thereby preparing a resin emulsion. Finally, after cooling to room temperature, the resultant dispersion was passed through a wire mesh having a 200 mesh screen (opening: 105 μm), thereby obtaining an emulsion (resin emulsion 4) containing finely dispersed resin particles which had a resin content of 29% by weight. As a result, it was confirmed that the primary particles contained in the resin emulsion 4 had a volume median particle size (D50) of 0.151 μm and a coefficient of variation (CV value) of particle size distribution of 24.7, and no resin components remained on the wire mesh. Meanwhile, a mixed resin containing the polyester A and the polyester B at a mixing weight ratio of 65/35 (wt/wt) exhibited a softening point of 114° C. and a glass transition point of 66° C.

Example 6

Six hundred grams of the resin emulsion 4 (having a resin content of 29% by weight) was sampled and charged into a 2 L three-necked separable flask at room temperature. Then, 734 g of a 5.5 wt % ammonium sulfate aqueous solution as an aggregating agent was added to the dispersion while stirring with a paddle-shaped stirrer at a rate of 100 rpm, and the contents of the flask were stirred at room temperature for 20 min. Thereafter, the mixed dispersion was heated from room temperature to 60° C. at a temperature rise rate of 0.3° C./min, and allowed to stand at 60° C. for 10 min, thereby obtaining a dispersion of aggregated particles having a volume median particle size of 7.6 μm.

Next, 418 g of a 5.8 wt % aqueous solution of an anionic surfactant "EMULE E-27C($C_{12}H_{25}O(C_2H_5O)_2SO_3Na$)" (15% by weight on the basis of resin) available from Kao Corporation was added to the resultant dispersion, and the obtained mixture was heated to 83° C. at a temperature rise rate of 0.2° C./min and then retained at the same temperature. At that time, the particle size and circularity of the particles obtained after respective retention times at 83° C. were measured. The results are shown in Table 2. Meanwhile, in Example 6, during the temperature rise until reaching 83° C., the time elapsed until reaching 83° C. from the time at which the temperature calculated from the "glass transition point of the resin binder+(plus) 10° C." (i.e., 74° C.) was reached, was 45 min, and therefore the heating time was the "respective retention time+(plus) 45 min". In the following Examples and Comparative Example, the heating time has the same meaning as described above.

Example 7

The dispersion of aggregated particles having a volume median particle size of 7.6 μm was prepared in the same manner as in Example 6.

Next, 418 g of a 2.7 wt % aqueous solution of an anionic surfactant "EMULE E-27C($C_{12}H_{25}O(C_2H_5O)_2SO_3Na$)" (7% by weight on the basis of resin) available from Kao Corporation was added to the resultant dispersion, and the obtained mixture was heated to 83° C. at a temperature rise rate of 0.2° C./min and then retained at the same temperature. At that time, the particle size and circularity of the particles obtained after the respective retention times at 83° C. were measured. The results are shown in Table 2.

Example 8

The dispersion of aggregated particles having a volume median particle size of 7.8 μm was prepared in the same manner as in Example 6.

Next, 418 g of a 1.2 wt % aqueous solution of an anionic surfactant "EMULE E-27C($C_{12}H_{25}O(C_2H_5O)_2SO_3Na$)" (3% by weight on the basis of resin) available from Kao Corporation was added to the resultant dispersion, and the obtained mixture was heated to 83° C. at a temperature rise rate of 0.2° C./min and then retained at the same temperature. At that time, the particle size and circularity of the particles obtained after the respective retention times at 83° C. were measured. The results are shown in Table 2.

Example 9

The dispersion of aggregated particles having a volume median particle size of 7.5 μm was prepared in the same manner as in Example 6.

Next, 418 g of a 0.58 wt % aqueous solution of an anionic surfactant "EMULE E-27C($C_{12}H_{25}O(C_2H_5O)_2SO_3Na$)" (1.5% by weight on the basis of resin) available from Kao Corporation was added to the resultant dispersion, and the obtained mixture was heated to 83° C. at a temperature rise rate of 0.2° C./min and then retained at the same temperature. At that time, the particle size and circularity of the particles obtained after the respective retention times at 83° C. were measured. The results are shown in Table 2.

Example 10

The dispersion of aggregated particles having a volume median particle size of 8.3 μm was prepared in the same manner as in Example 6.

Next, 418 g of a 2.7 wt % aqueous solution of an anionic surfactant "EMULE 20C($C_{12}H_{25}O(C_{12}H_{25}O)_3SO_3Na$)" (7% by weight on the basis of resin) available from Kao Corporation was added to the resultant dispersion, and the obtained mixture was heated to 83° C. at a temperature rise rate of 0.2° C./min and then retained at the same temperature. At that time, the particle size and circularity of the particles obtained after the respective retention times at 83° C. were measured. The results are shown in Table 2.

Example 11

The dispersion of aggregated particles having a volume median particle size of 6.7 μm was prepared in the same manner as in Example 6.

Next, 418 g of a 2.7 wt % aqueous solution of an anionic surfactant "EMULE 0 ($C_{12}H_{25}OSO_3Na$)" (7% by weight on the basis of resin) available from Kao Corporation was added to the resultant dispersion, and the obtained mixture was heated to 83° C. at a temperature rise rate of 0.2° C./min and then retained at the same temperature. At that time, the particle size and circularity of the particles obtained after the respective retention times at 83° C. were measured. The results are shown in Table 2.

Comparative Example 5

The dispersion of aggregated particles having a volume median particle size of 8.0 μm was prepared in the same manner as in Example 6.

Next, 418 g of a 2.7 wt % aqueous solution of an anionic surfactant "LATEMUL ASK (dipotassium alkenylsuccinate)" (7% by weight on the basis of resin) available from Kao Corporation was added to the resultant dispersion, and the obtained mixture was heated to 83° C. at a temperature rise rate of 0.2° C./min and then retained at the same temperature. At that time, the particle size and circularity of the particles obtained after the respective retention times at 83° C. were measured. The results are shown in Table 2.

TABLE 2-1

| | Examples | | | |
|---|---|---|---|---|
| | 6 | 7 | 8 | 9 |
| Polyester | | | | |
| Softening point (° C.) | 114 | 114 | 114 | 114 |
| Glass transition point (° C.) | 64 | 64 | 64 | 64 |
| Aggregating agent | Ammonium sulfate | Ammonium sulfate | Ammonium sulfate | Ammonium sulfate |
| Aggregating temperature (° C.) | 60 | 60 | 60 | 60 |
| Particle size of aggregated particles (μm) | 7.6 | 7.6 | 7.8 | 7.5 |
| Aggregation stopping agent | SA*1 | SA*1 | SA*1 | SA*1 |
| Amount of aggregation stopping agent added (weight parts based on resin) | 15 | 7 | 3 | 1.5 |
| Unifying temperature (° C.) | 83 | 83 | 83 | 83 |
| Particle size of unified particles | | | | |
| After retention time of 0 h | 8.6 | 7.3 | 7.2 | 6.4 |
| After retention time of 2 h | 7.9 | 6.9 | 6.5 | 6.1 |
| After retention time of 4 h | 7.7 | 6.5 | 6.4 | 6.1 |
| After retention time of 6 h | | | | |
| Circularity of unified particles | | | | |
| After retention time of 0 h | 0.925 | 0.928 | 0.928 | 0.933 |
| After retention time of 2 h | 0.952 | 0.940 | 0.942 | 0.952 |
| After retention time of 4 h | 0.971 | 0.952 | 0.954 | 0.960 |
| After retention time of 6 h | | | | |

Note
*1Sodium polyoxyethylene (2 mol) dodecylethersulfate

TABLE 2-2

| | Examples | | Comparative |
|---|---|---|---|
| | 10 | 11 | Example 5 |
| Polyester | | | |
| Softening point (° C.) | 114 | 114 | 114 |
| Glass transition point (° C.) | 64 | 64 | 64 |
| Aggregating agent | Ammonium sulfate | Ammonium sulfate | Ammonium sulfate |
| Aggregating temperature (° C.) | 60 | 60 | 60 |
| Particle size of aggregated particles (μm) | 8.3 | 6.7 | 8.0 |
| Aggregation stopping agent | SA*3 | SA*2 | SA*7 |
| Amount of aggregation stopping agent added (weight parts based on resin) | 7 | 7 | 7 |
| Unifying temperature (° C.) | 83 | 83 | 83 |
| Particle size of unified particles | | | |
| After retention time of 0 h | 6.9 | 8.5 | 8.3 |
| After retention time of 2 h | 5.6 | 7.9 | 8.7 |
| After retention time of 4 h | 5.5 | 7.6 | 9.8 |
| After retention time of 6 h | 5.7 | 7.3 | 11.2 |
| Circularity of unified particles | | | |
| After retention time of 0 h | 0.934 | 0.920 | 0.920 |
| After retention time of 2 h | 0.948 | 0.943 | 0.928 |
| After retention time of 4 h | 0.958 | 0.958 | 0.937 |
| After retention time of 6 h | 0.966 | 0.972 | 0.946 |

Note
*3Sodium polyoxyethylene (3 mol) dodecylethersulfate
*2Sodium dodecylsulfate
*7Dipotassium alkenylsuccinate

What is claimed is:

1. A process for producing a toner for electrophotography, comprising:

(a) emulsifying a resin binder comprising a polyester in an aqueous medium to produce resin particles;

(b) aggregating the resin particles in an aqueous medium; and (c) unifying the aggregated resin particles, wherein (b) comprises:

(a-1) adding a monovalent salt as an aggregating agent prior to the aggregation; and (a-2) adding at least one aggregation stopping agent selected from the group consisting of (i) alkylethersulfates represented by the formula (1)

$$R—O—(CH_2CH_2O)_nSO_3M, \quad (1)$$

wherein R is an alkyl group; n represents an average molar number of addition and is a number of more than 0 and not more than 15 ($0<n\leqq 15$), and M is a monovalent cation, (ii) alkylsulfates; and (iii) linear alkylbenzenesulfonates, at the time at which a volume median particle size (D50) of the aggregated resin particles reaches from 90 to 120% of the volume median particle size (D50) of the resultant unified particles.

2. The process according to claim 1, wherein the at least one aggregation stopping agent is added in an amount of 0.5 to 15 parts by weight on the basis of 100 parts by weight of the resin binder.

3. The process according to claim 1, wherein (b) further comprises aggregating emulsified particles contained in an emulsion obtained in (a) at a temperature not higher than the temperature calculated from the glass transition point of the resin binder; wherein in (a-2) the at least one compound selected from the group consisting of alkylethersulfates represented by the formula (1) and alkylsulfates is added in an amount of 1.0 part by weight or more on the basis of 100 parts by weight of the resin binder; and the unifying (c) is conducted by heating the aggregated particles for 2 h or longer at a temperature not lower than the temperature calculated from the glass transition point of the resin binder plus 10° C. and not higher than the temperature calculated from the softening point of the resin binder minus 10° C., thereby unifying the aggregated particles.

4. The process according to claim 1 or 3, wherein the monovalent salt is a water-soluble nitrogen-containing compound having a molecular weight of 350 or less.

5. A toner for electrophotography which is produced by the process according to claim 1 or 3.

6. A toner for electrophotography which is produced by the process according to claim 1, wherein particles of the toner have a volume median particle size (D50) of from 1 to 6 μm and a coefficient of variation (CV value) of particle size distribution of 25 or less.

7. A toner for electrophotography which is produced by the process according to claim 3, wherein particles of the toner have an average circularity of 0.94 or more.

8. A method for controlling a shape of a toner, comprising:

aggregating emulsified particles contained in an emulsion obtained by emulsifying a resin binder comprising a polyester in an aqueous medium, at a temperature not higher than the temperature calculated from the glass transition point of the resin binder plus 20° C. by adding a monovalent salt as an aggregating agent thereto;

adding at least one compound selected from the group consisting of alkylethersulfates represented by the formula (1):

$$R—O—(CH_2CH_2O)_nSO_3M \quad (1),$$

wherein R is an alkyl group; n represents an average molar number of addition and is a number of more than 0 and not more than 15 ($0<n\leqq 15$), and M is a monovalent cation and alkylsulfates, in an amount of 1.0 part by weight or more on the basis of 100 parts by weight of the resin binder, thereby stopping aggregation of the particles; and heating the aggregated particles for 2 h or longer at a temperature not lower than the temperature calculated from the glass transition point of the resin binder plus 10° C. and not higher than the temperature calculated from the softening point of the resin binder minus 10° C., thereby unifying the aggregated particles.

9. The process according to claim 1, wherein the at least one aggregation stopping agent in (a-2) is selected from the group consisting of (i) alkylethersulfates represented by the formula (1) and (ii) alkylsulfates.

10. The process according to claim 1, wherein emulsifying the resin binder in the aqueous medium is conducted by dispersing the resin binder in the aqueous medium, neutralizing the resultant dispersion, and then adding an aqueous medium thereto.

* * * * *